US011437165B2

(12) United States Patent
Lee

(10) Patent No.: US 11,437,165 B2
(45) Date of Patent: Sep. 6, 2022

(54) TRANSMISSION CABLE AND MANUFACTURING METHOD FOR THE SAME

(71) Applicant: James Cheng Lee, La Habra, CA (US)

(72) Inventor: James Cheng Lee, La Habra, CA (US)

( * ) Notice: Subject to any disclaimer, the term of this patent is extended or adjusted under 35 U.S.C. 154(b) by 0 days.

(21) Appl. No.: 17/170,910

(22) Filed: Feb. 9, 2021

(65) Prior Publication Data

US 2021/0327608 A1 Oct. 21, 2021

Related U.S. Application Data

(60) Provisional application No. 63/012,429, filed on Apr. 20, 2020.

(30) Foreign Application Priority Data

Jan. 22, 2021 (CN) ..... 202110086836.8

(51) Int. Cl.
*H01B 7/02* (2006.01)
*H01B 1/02* (2006.01)

(52) U.S. Cl.
CPC ..... *H01B 7/0216* (2013.01); *H01B 1/02* (2013.01)

(58) Field of Classification Search
CPC ..... H01B 1/02; H01B 7/02; H01B 7/0216; H01B 7/18; H01B 7/0225; H01B 11/02; H01B 13/26; H01B 13/08
USPC ..... 174/110 R, 110 N–110 PM, 174/120 R–121 AR
See application file for complete search history.

(56) References Cited

U.S. PATENT DOCUMENTS

| | | | | |
|---|---|---|---|---|
| 3,964,945 | A * | 6/1976 | Everhart | H01B 7/285 156/56 |
| 4,322,574 | A * | 3/1982 | Bow | H01P 1/30 428/377 |
| 4,725,693 | A * | 2/1988 | Hirsch | B32B 7/14 174/106 SC |
| 6,392,153 | B1 * | 5/2002 | Horwatt | H01B 7/295 174/121 A |
| 2008/0217043 | A1 * | 9/2008 | Schoke | H02G 3/0412 174/11 OR |
| 2009/0081435 | A1 * | 3/2009 | Gottfried | H01B 7/29 428/411.1 |
| 2014/0102758 | A1 * | 4/2014 | Pagliuca | B32B 27/283 174/120 SR |

* cited by examiner

*Primary Examiner* — William H. Mayo, III
(74) *Attorney, Agent, or Firm* — Lin & Associates Intellectual Property, Inc.

(57) ABSTRACT

A transmission cable includes a conductor and a composite layer. The composite layer is formed by having an inner surface of an outer wrap layer adhered to an outer surface of an inner wrap layer with a glue material. The composite layer wraps the conductor and an inner surface of the inner wrap layer is in contact with an outer surface of the conductor. The inner wrap layer is made of polytetrafluoroethylene with a foaming degree of 65% to 77%, and the outer wrap layer is made of polyimide. The composite layer is made by drawing cable at a rate of 0.1-0.5 m/min and taping with an overlap percentage between 32% and 37% during a wrapping process.

2 Claims, 5 Drawing Sheets

TRANSMISSION CABLE AND MANUFACTURING METHOD FOR THE SAME

BACKGROUND OF THE INVENTION

1. Field of the Invention

The present invention relates to a cable structure and a manufacturing method for the same, and particularly to a high speed/frequency transmission cable and a manufacturing method for the same.

2. The Prior Arts

In an existing process of manufacturing a transmission cable, an insulation layer is directly pressed on a conductor to achieve the effects of protection and insulation. As shown in FIG. 1, a conductor 10 of a transmission cable 1 is covered with an insulation layer 11. Since a dielectric constant of the insulation layer has a great influence on the performance of high speed/frequency transmission cable, foam materials are usually used to reduce the dielectric constant. However, it is not easy for the foam materials to meet with the standard requirement of distribution and yield in a manufacturing process. Also, an outer diameter of the transmission cable made of the foam material is relatively large, which limits the size selectivity of the transmission cable.

Therefore, the wrapping process is used to improve the above problems. The transmission loss of the cable produced by the wrapping process at high speed/frequency is lower than that by the foaming process. However, the mechanical properties of the wrapped cable, such as bending strength, tensile strength and elongation, are insufficient, and thus it is easy for the wrapped cable to be bent during the cable management and the manufacturing process, which may cause the core to break and reduce the yield.

Therefore, it is needed to provide a cable structure that can improve the bending strength, tensile strength, and elongation.

SUMMARY OF THE INVENTION

The present invention provides a transmission cable. A transmission cable includes a conductor and a composite layer. The composite layer is formed by an inner surface of an outer wrap layer adhered to an outer surface of an inner wrap layer by a glue material. The composite layer wraps the conductor and an inner surface of the inner wrap layer is in contact with an outer surface of the conductor. The inner wrap layer is made of polytetrafluoroethylene with a foaming degree of 65%-77%, and the outer wrap layer is made of polyimide. The composite layer is made by drawing cable at a rate of 0.1-0.5 m/min and taping with an overlap percentage between 32% and 37% during a wrapping process.

The present invention provides a manufacturing method for a transmission cable, comprising the following steps: adhering an inner surface of an outer wrap layer to an outer surface of an inner wrap layer by a glue material to form a composite layer; and wrapping a conductor by the composite layer to form a transmission cable and an inner surface of the inner wrap layer in contact with an outer surface of the conductor. The inner wrap layer is made of polytetrafluoroethylene with a foaming degree of 65%-77%, and the outer wrap layer is made of polyimide. The composite layer is made by drawing cable at a rate of 0.1-0.5 m/min and taping with an overlap percentage between 32% and 37% during a wrapping process.

Those having ordinary skill in the art will understand that the achieved effects through the disclosure of the present invention are not limited to those specifically described above, and the advantages of the present invention will be more clearly understood from the below detailed description in conjunction with the drawings.

DETAILED DESCRIPTION OF THE PREFERRED EMBODIMENT

Figure 1:
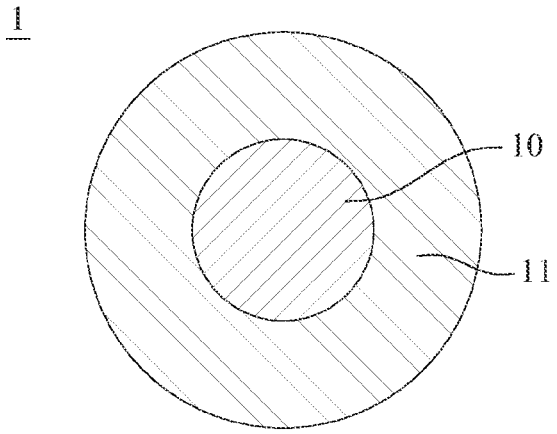
FIG. 1 (PRIOR ART)
FIG. 1 illustrates a transmission cable manufactured by wrap technology of the prior art.
Figure 2:
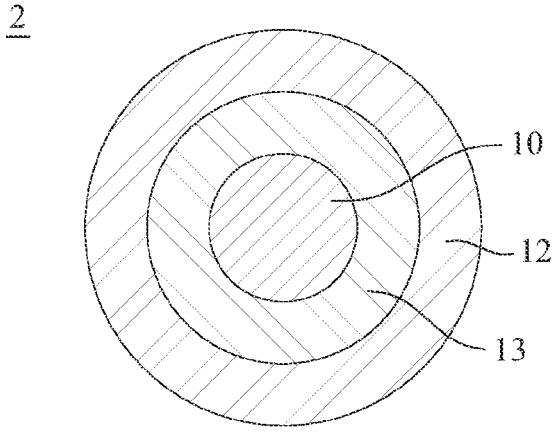
FIG. 2 illustrates a transmission cable according to an embodiment of the present invention.
Figure 3A:
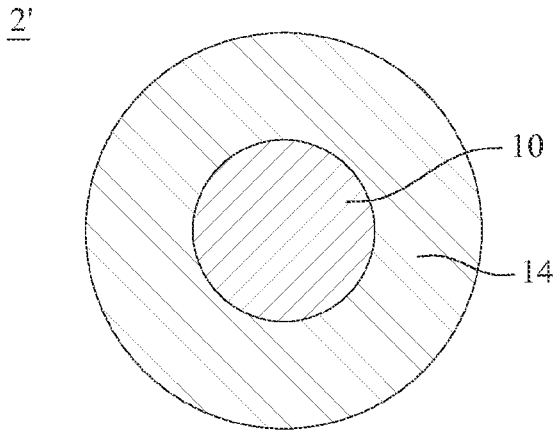
FIG. 3A illustrates a transmission cable according to another embodiment of the present invention.
Figure 3B:
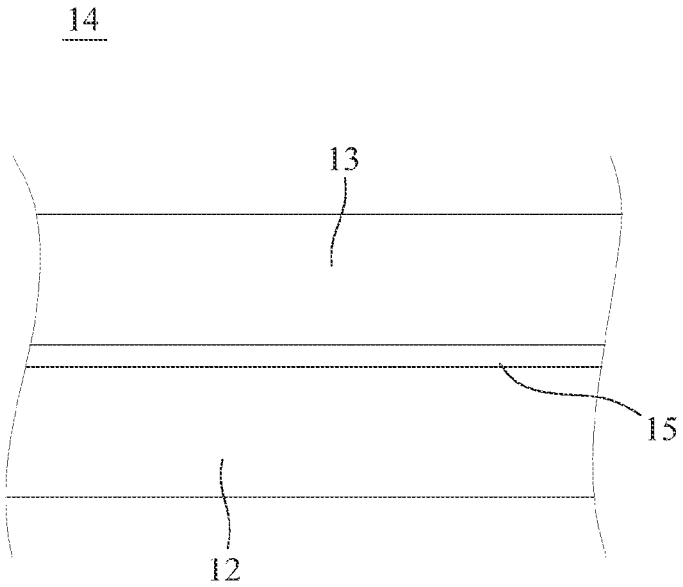
FIG. 3B shows a partial structure of the transmission cable of FIG. 3A.

With reference to FIGS. 2, 3A and 3B, FIG. 2 illustrates a transmission cable according to an embodiment of the present invention. The transmission cable 2 sequentially includes a conductor 10, an inner wrap layer 13, and an outer wrap layer 12 from the inside to the outside. FIG. 3A illustrates a transmission cable 2' according to another embodiment of the present invention, and FIG. 3B shows a partial structure of the transmission cable 2' of FIG. 3A. As shown in FIG. 3B, the difference between this embodiment and FIG. 2 is that an inner surface of the outer wrap layer 12 is adhered to an outer surface of the inner wrap layer 13 by a glue material 15 to form a composite layer 14. In such a way, it only requires one wrapping process of the composite layer 14 to wrap the conductor 10 with the outer wrap layer 12 and the inner wrap layer 13 and an inner surface of the inner wrap layer 13 is in contact with an outer surface of the conductor 10 to achieve a two-layer protection effect. It should be noted that in the embodiment, the outer wrap layer 12 and the inner wrap layer 13 are respectively composed of at least two layers of high molecular polymers through the glue material 15.

Figure 4:
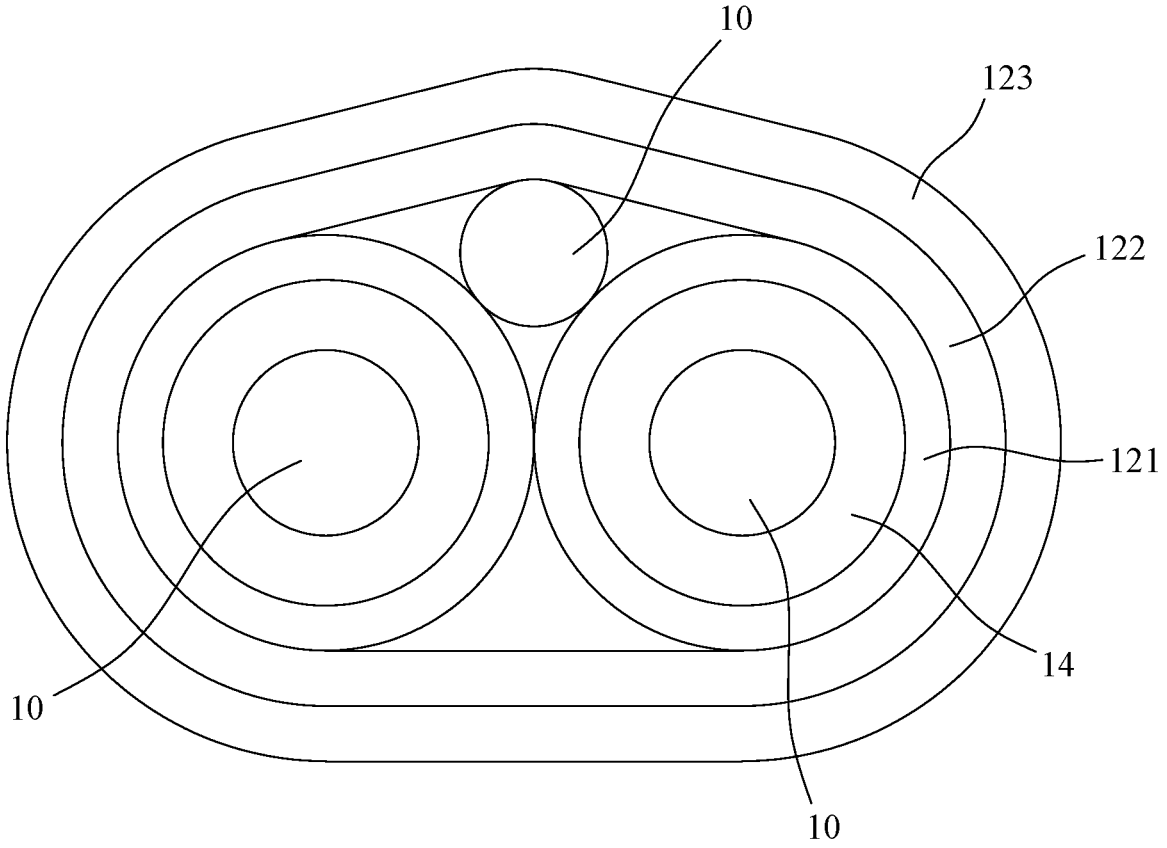
FIG. 4 illustrates a transmission cable based on the embodiment of FIG. 3A.

With reference to FIG. 4, FIG. 4 illustrates a transmission cable 2' based on the embodiment of FIG. 3A. As shown in FIG. 4, two transmission cables 2' with the structure of FIG. 3A and a conductor 10 are coated with a first wrap layer 121, a second wrap layer 122, and a third wrap layer 123 to form a transmission cable module 20. The first wrap layer 121 is mainly composed of the material of the outer wrap layer 12 mentioned above and covers an outer surface of the composite layer 14 by the glue material 15. Similarly, the second wrap layer 122 is composed of the material of the outer wrap layer 12 mentioned above and covers a part of outer surfaces of the first wrap layers 121 and a part of the conductor 10 by the glue material 15, and the third wrap layer 123 is composed of the material of the outer wrap layer 12 mentioned above and covers an outer surface of the wrap layer 122 by the glue material 15. It should be noted that, preferably, the first wrap layer 121, which is similar to the outer wrap layer 12 and the inner wrap layer 13, is also composed of at least two layers of high molecular polymers through the glue material 15. In addition, in a preferred embodiment of the present invention, the outer wrap layer 12 included in the composite layer 14 has a thickness of 0.012-0.024 mm, which is made of polyimide (i.e., PI or Kapton) material. The composite layer 14 also contains a glue material 15 with a thickness of 0.01-0.02 mm, and the inner wrap layer 13 has a thickness of 0.15 mm, which is made of polytetrafluoroethylene with a foaming degree of 65%-77% (the dielectric constant is 2.1 before foaming, and 1.25-1.39 after foaming). The composite layer 14 is made by drawing cable at a rate of 0.1-0.5 m/min and taping with an overlap percentage between 32% and 37% during the wrapping process. The above-mentioned material, thickness, cable-drawing rate, and tape overlap percentage are only the preferred examples of the present invention, and are not intended to limit the present invention.

In such a way, the composite layer of the present invention, such as the composite layer of PTFE material, can achieve higher roundness, higher impedance and lower insertion loss than the prior art using two layers of PTFE. The two layers of PTFE used for comparison here is made of PTFE with a foaming degree of 65%, a cable drawing rate of 0.3 m/min and an overlap percentage of 50% during the wrapping process. Preferably, the embodiment of the present invention can achieve a roundness of 93% or more, while the prior art can only achieve a roundness of 80-85%. Also, the embodiment of the present invention can achieve a differential impedance of 105 ohms, which is higher than 99 ohms of the prior art, and have an insertion loss (I/L) lower than that of the prior art. Preferably, the embodiment of the present invention can achieve the insertion loss of −2.97 dB, while the prior art can only achieve the insertion loss of −3.4 dB.

Figure 5:
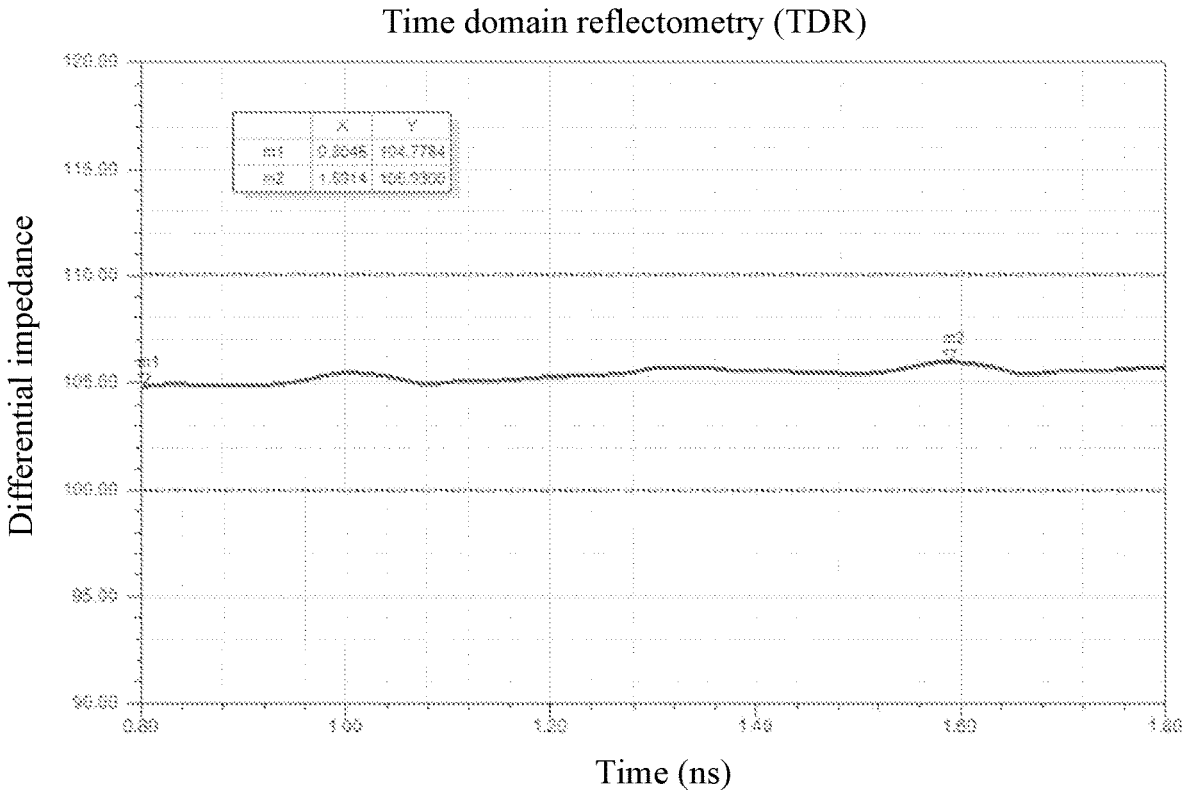
FIG. 5 illustrates a curve diagram of a time-domain reflectometry measurement according to an embodiment of the present invention.

With reference to FIG. 5, FIG. 5 illustrates a curve diagram of a time-domain reflectometry measurement according to an embodiment of the present invention. As shown in FIG. 5, a numerical curve obtained by performing time domain reflectometry (TDR) to a transmission cable 2' made with the above-mentioned preferred values of the present invention contains two points m1 (0.8045, 104.7784) and m2 (1.5914, 105.9300), which fall within the differential impedance range of 100-110 ohm, while the differential impedances of the prior art only fall below 100 ohm.

Figure 6:
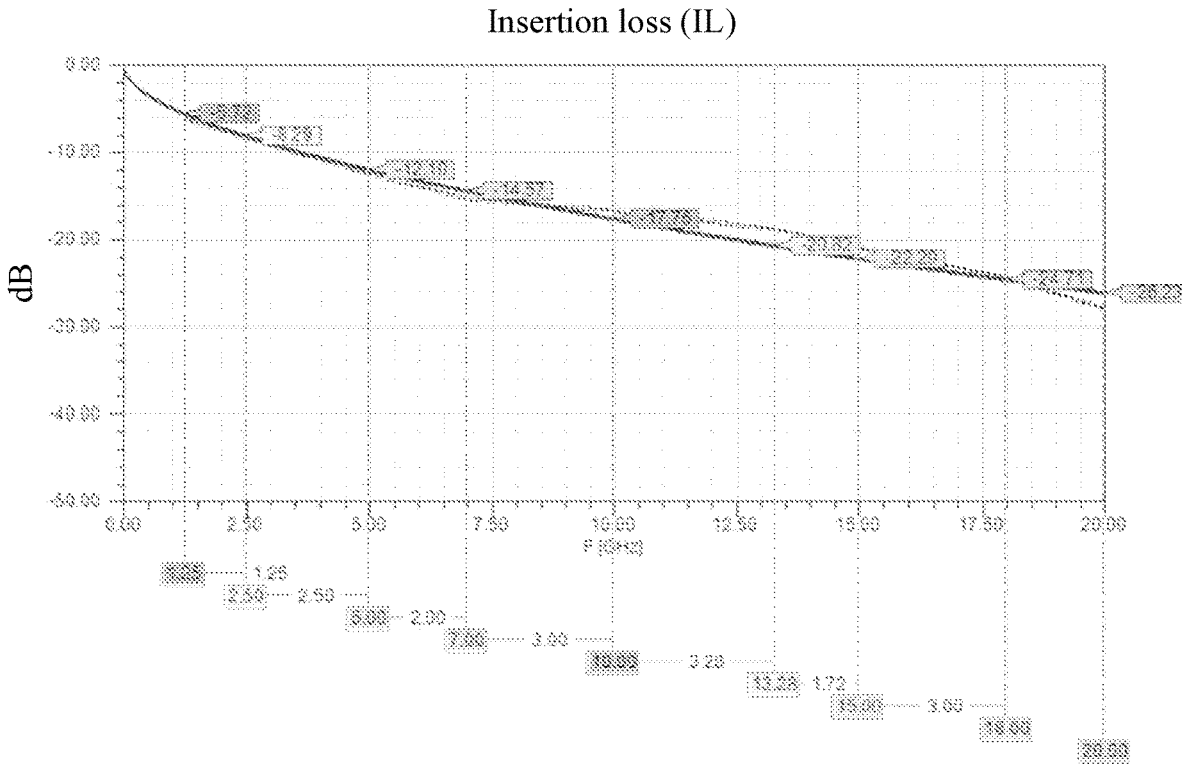
FIG. 6 illustrates a curve diagram of an insertion loss measurement according to an embodiment of the present invention.

With reference to FIG. 6, FIG. 6 illustrates a curve diagram of an insertion loss measurement according to an embodiment of the present invention. As shown in FIG. 6, the dashed curve represents the values of the insertion loss for the transmission cable made with the above-mentioned preferred values of the present invention, while the solid curve represents the threshold values of the insertion loss. The values for some sections of the curve according to the embodiment of the present invention may be below the threshold values, while the values of the prior art all exceed the threshold values.

It is obvious to a person having ordinary knowledge in the technical field that the present invention can be implemented in other specific forms without departing from the spirit of the present invention. Therefore, the above description should not be understood as limiting but illustrative in all respects.

The scope of the present invention should be determined by a reasonable explanation of the scope of the present invention, and all variations within the scope of equivalents of the present invention are included in the scope of the present invention.

What is claimed is:

1. A transmission cable, comprising:

a conductor; and a composite layer formed by an inner wrap layer and an outer wrap layer, an inner surface of the outer wrap layer being adhered to an outer surface of the inner wrap layer by a glue material before the composite layer is wrapped around the conductor;

wherein the composite layer wraps the conductor and an inner surface of the inner wrap layer is in contact with an outer surface of the conductor;

wherein the inner wrap layer is made of polytetrafluoroethylene with a foaming degree of 65% to 77%, and the outer wrap layer is made of polyimide; and wherein the composite layer is made by drawing cable at a rate of 0.1-0.5 m/min and taping with an overlap percentage between 32% and 37% during a wrapping process.

2. A manufacturing method for a transmission cable, comprising the following sequential steps:

adhering an inner surface of an outer wrap layer to an outer surface of an inner wrap layer by a glue material to form a composite layer; and wrapping a conductor by the composite layer to form a transmission cable with an inner surface of the inner wrap layer being in contact with an outer surface of the conductor;

wherein the inner wrap layer is made of polytetrafluoroethylene with a foaming degree of 65% to 77%, and the outer wrap layer is made of polyimide; and wherein the composite layer is made by drawing cable at a rate of 0.1-0.5 m/min and taping with an overlap percentage between 32% and 37% during a wrapping process.

* * * * *